US006399866B2

(12) United States Patent
Tanaka

(10) Patent No.: US 6,399,866 B2
(45) **Date of Patent: *Jun. 4, 2002**

(54) PERCUSSION INSTRUMENT WITH PEDAL SYSTEM HAVING INTERCHANGEABLE CAM ELEMENTS

(75) Inventor: Yukio Tanaka, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/759,515

(22) Filed: Jan. 16, 2001

Related U.S. Application Data

(63) Continuation-in-part of application No. 09/375,413, filed on Aug. 17, 1999, now Pat. No. 6,172,291.

(51) Int. Cl.[7] ..... G10D 13/02
(52) U.S. Cl. ..... 84/422.1; 84/422.2; 84/422.3
(58) Field of Search ..... 84/422.3, 422.1, 84/422.2

(56) References Cited

U.S. PATENT DOCUMENTS

| | | | | |
|---|---|---|---|---|
| 3,797,356 A | | 3/1974 | Duffy et al. | 84/422.1 |
| 4,346,638 A | | 8/1982 | Hoshino | 84/422.1 |
| 4,756,224 A | | 7/1988 | Lombardi | 84/422.1 |
| 4,905,565 A | * | 3/1990 | Hoshino | 84/422.3 |
| 5,398,584 A | | 3/1995 | Liao | 84/422.1 |
| 5,613,275 A | | 3/1997 | Kolberg et al. | 16/441 |
| 5,714,701 A | | 2/1998 | Hsieh | 84/422.1 |

OTHER PUBLICATIONS

Gibraltar Hardware Brochure, KCP–507, Printed in USA, 60M, 3/99.
Masters Series Brochure, Printed in Japan, Item #M100.
Tama 2000 Brochure, Hoshino Gakki Co., Ltd., Copyright 2000, Jan 00311, Printed in Japan.
Mapex Snare Drum & Hardware Brochure, Printed in Taiwan Jan. 2000, PMK—M213.
Gibraltar Hardware Brochure, KCP–507, Printed in USA, 60M, Mar. 1999.
Masters Series Brochure, Printed in Japan, Item #M100.
Tama 2000 Brochure, Hoshino Gakki Co., Ltd., Copyright 2000, Jan 00311, Printed in Japan.

* cited by examiner

*Primary Examiner*—Shih-Yung Hsieh
(74) *Attorney, Agent, or Firm*—Liniak, Berenato, Longacre & White

(57) ABSTRACT

A foot-operated percussion instrument is provided with a series of interchangeable cam members selectively disposed on a sprocket hub mounted on the rotating axle disposed between the two upright posts. The interchangeable cam system permits a user to alter the performance characteristics or playing response of the foot-operated system by changing the cam profile for the pedal. The user need not disassemble the entire sprocket and hub assembly; rather, the cam profile is changed by selectively changing a detachable cam member with one of a series of cam members. The invention is suitable for a hi-hat cymbal system or a drum beater system.

17 Claims, 10 Drawing Sheets

PERCUSSION INSTRUMENT WITH PEDAL SYSTEM HAVING INTERCHANGEABLE CAM ELEMENTS

This application is a continuation-in-part of U.S. patent application Ser. No. 09/375,413 filed Aug. 17, 1999, now U.S. Pat. No. 6,172,291.

BACKGROUND OF THE INVENTION a) Field of the Invention

This invention relates generally to improvements in percussion equipment; more particularly, the invention provides an enhanced pedal system having interchangeable cam profile members for attachment to the drum pedal sprocket to thereby enhance drum performance and versatility.

b) Description of Related Art

Current hi-hat systems include a drive chain or strap directly connecting the foot pedal to a vertically movable rod that drives an upper movable cymbal to strike a lower fixed cymbal. Prior art FIG. 1 typifies such a foot pedal assembly.

In addition, current drum technology (e.g., bass drum technology) includes foot-operated percussion assemblies wherein the pedals are manufactured with a sprocket and hub assembly disposed on a shaft. The sprocket and hub assembly engages a drive chain or strap driven by the pedal. The strap rides along a cam surface to provide a predetermined beater speed and playing response. Each sprocket and hub assembly is provided with a particular cam shape and, thus, a particular playing response.

The cam shape associated with the sprocket and hub assembly directly affects the beater speed for the percussion instrument. The sprocket and hub assembly mounted on the instrument drum pedal shaft is provided to limit the travel distance of the beater for a drum; thus, with the same stepping force acting on the pedal, a user may have different playing response based on the movement of the actuator; e.g. beater. Conventional percussion systems do not provide a convenient and versatile manner for the user to alter the cam shape. Rather, when a user's cam preference changes, that user must either purchase a new pedal system or replace an entire sprocket and hub assembly defining the cam shape.

From this description, it is noted that many kinds of products sold in the market cannot fulfill the requirements of a percussion instrument user and, consequently, there is a long and unfulfilled need for a convenient and versatile cam assembly for use in pedal-operated percussion systems constructed in accordance with the present invention which tends to litigate or obviate the aforementioned problems.

SUMMARY OF THE INVENTION

The present invention provides a unique interchangeable cam system wherein a user may alter the performance characteristics or playing response of a single pedal system by changing the cam profile for that pedal. The user need not disassemble the entire sprocket and hub assembly; rather, the cam profile is changed by selectively changing a detachable cam member with one of a series of cam members.

The present invention further provides a unique and efficient connection and disconnection system for quickly and efficiently removing and replacing a cam member on a sprocket assembly of a percussion instrument pedal system.

The invention is embodied in a foot-operated, percussion pedal assembly including a pair of horizontally extending elongated struts, two upright members attached to the struts, and a horizontal axle supported by the two upright members for rotation about a horizontal axis. At least one sprocket is carried by the axle at a support location, and the sprocket has peripheral chain engaging portion affixed to a chain. An end portion of the chain is anchored to the sprocket, and the chain has a mid-portion engaging the sprocket along a detachable and interchangeable cam member. A pedal has a rear portion hingedly supported by the plate and a front portion attached to the chain, and the instrument actuator is driven by the axle through the sprocket and cam member. In the preferred embodiment of this invention, the interchangeable cam system is employed on a hi-hat percussion system to drive the moveable rod that actuates the cymbal.

As opposed to prior art hi-hat percussion instruments, the drive mechanism of the present invention comprises a drive axle upon which is mounted at least one sprocket member for actuating the cymbal members. With this invention, the movement and precision of the vertically movable rod is stabilized and enhanced compared to the prior art systems because the movable rod is driven by the drive axle and the sprocket members disposed on the drive axle. The prior art arrangement simply utilizes a hinged pedal hanging from a biased movable rod and connected therebetween by a flexible chain, and actuation of the cymbals with this conventional arrangement is less stable and less accurate. Accordingly, the present invention provides not only a more versatile actuation system, but also a sturdy, compact, reliable and more accurate pedal unit.

As a result of the interchangeable cam profile member, the reaction speed of the drum actuation system in response to pedal movement may be altered and enhanced for more accurately timed cymbal actuation or drum beating based on the profile of the interchangeable cam member being utilized by the user. The rate of pedal return to the up-position may be changed to more effectively position the pedal for a subsequent, down push, for the next percussion sound.

The present invention also provides an infinite number of possible cam profiles without substantially impacting the overall design and performance of the other components of the pedal system.

These and other objects and advantages of the invention, as well as the details of an illustrative embodiment will be more fully understood from the following specification and drawings.

DETAILED DESCRIPTION OF THE PREFERRED EMBODIMENTS

The percussion instrument 10 includes multiple, relatively telescoping sections. These include for example upper section 11 telescopically receivable within the lower section 12. A clamp 14 mounted at 15 on the upper section of section 12 is manually operable to clamp a friction ring against the side of section 11, thereby to retain the sections in the position shown. When the clamps are loosened, the sections are relatively telescopically movable from a collapsed position to a desired extended position, as manually controlled by the musician when he or she sets up the equipment.

Figure 1:
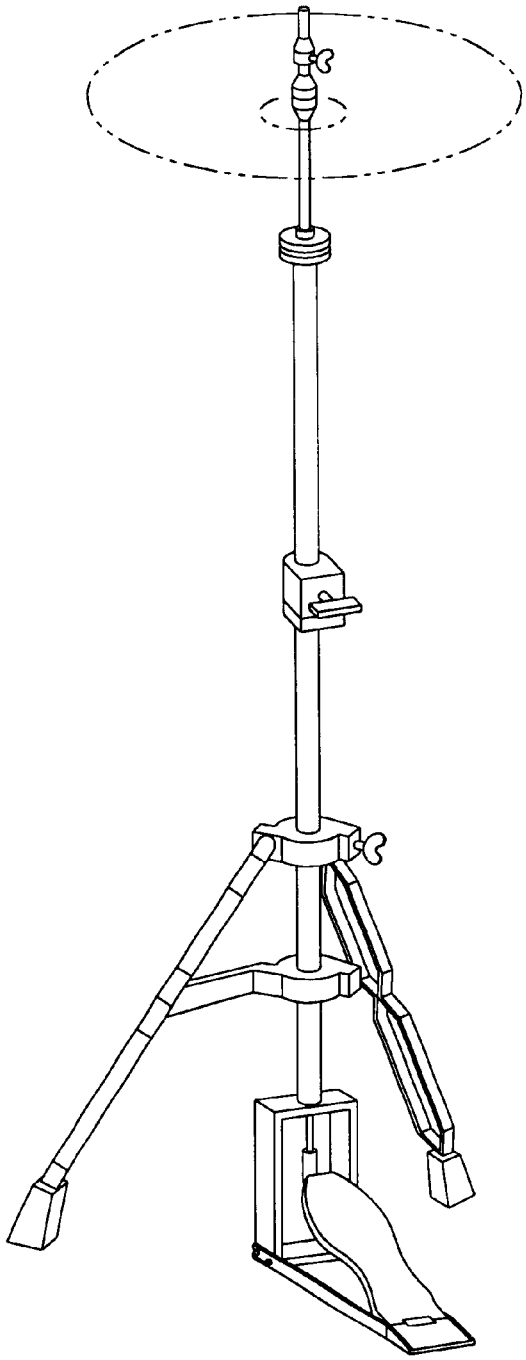
Fig. 1 Prior Art
FIG. 1 is a perspective view of a prior art hi-hat assembly.
Figure 2:
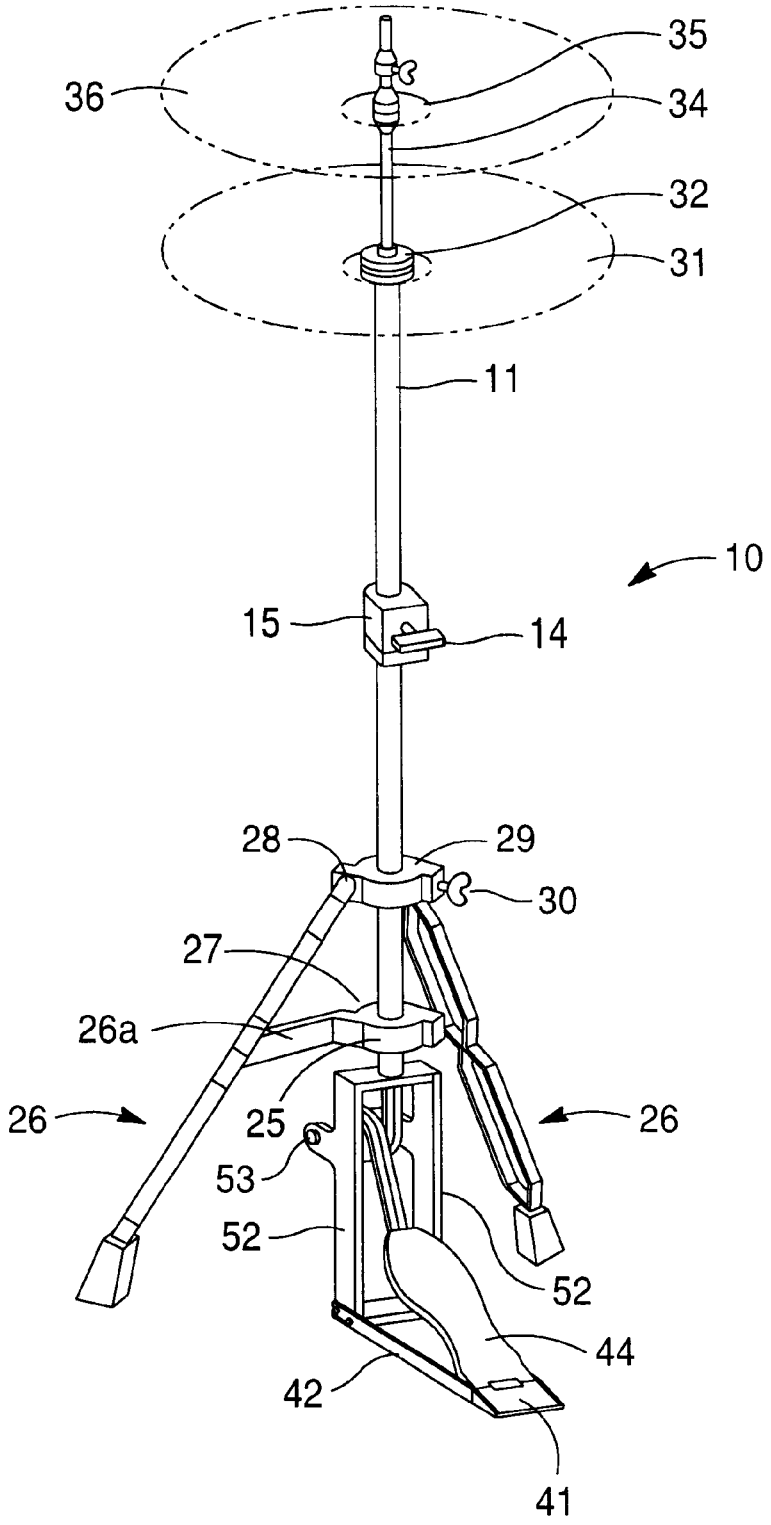
FIG. 2 is a perspective view of a percussion apparatus incorporating the invention.

FIG. 2 also shows two collapsible legs 26 with links 26*a* attached at 27 to ring 25 on the lower section and at 28 to a slide ring 29 slidable axially on the lower section. A clamp 30 clamps the ring to that section. Rings 25 and 29 are rotatable on 12 to selectively position the legs relative to the foot-operated pedal assembly 40 and associated upright posts 52. As will be described in more detail below, a foot pedal assembly is centrally located with respect to the collapsible legs 26. Also schematically shown in FIG. 2 is a lower cymbal 31 attached at 32 to the upper tubular section 11. A vertically movable rod 34 is attached at 35 to a movable, upper cymbal 36. As the rod 34 is drawn in a downward direction by action on the foot pedal assembly 40, the upper cymbal 36 strikes the lower cymbal 31.

Figure 3:
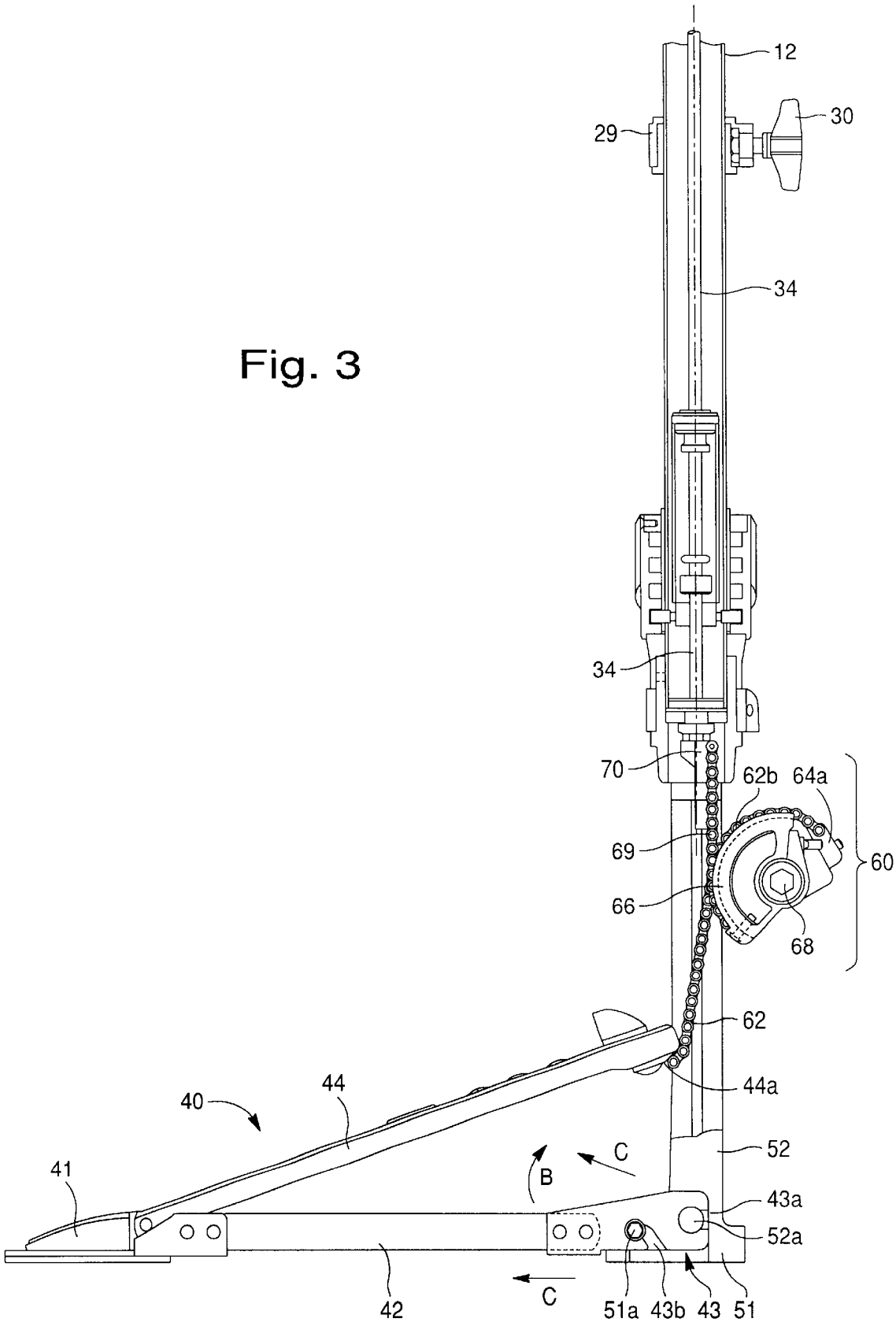
FIG. 3 is a partial cross sectional view of the percussion instrument incorporating the invention.

With reference to FIG. 3, the foot-operated pedal assembly 40 illustrated herein includes a pair of forwardly longitudinally elongated struts 42 to which a foot-operated pedal 44 is pivotally attached. Each elongated strut is provided with detachable fastening means 43 at its forward end. The fastening means 43 permits the pedal assembly 40 to be detached from the pair of upright posts 52, and the fastening means 43 consist of forwardly facing forks 43*a* and downwardly facing L-shaped slots 43*b*. The forwardly facing forks 43*a* engage transverse pins 52*a* provided on each upright post 52, and the downwardly facing L-shaped slots 43*b* engage with a locking screw or nut member 51*a* threadingly disposed on the base portion 51 supporting the upright posts 52. To disassemble the foot-operated pedal assembly 40 from the base portion 51 and upright posts 52, a user loosens the screw or nut member 51*a,* then slides the elongated struts in the rearward direction (see arrow 'A'), then lifts the elongated struts in an upright direction (see arrow 'B') to disengage the L-shaped slots 43*b* from the screw or nut member 51*a*. Then, the user pulls the foot-operated pedal assembly 40 away from the transverse pins 52*a* (see arrow 'C') to thereby disengage the foot-operated pedal assembly from the base portion 51 and the upright posts 52.

Figure 3A:
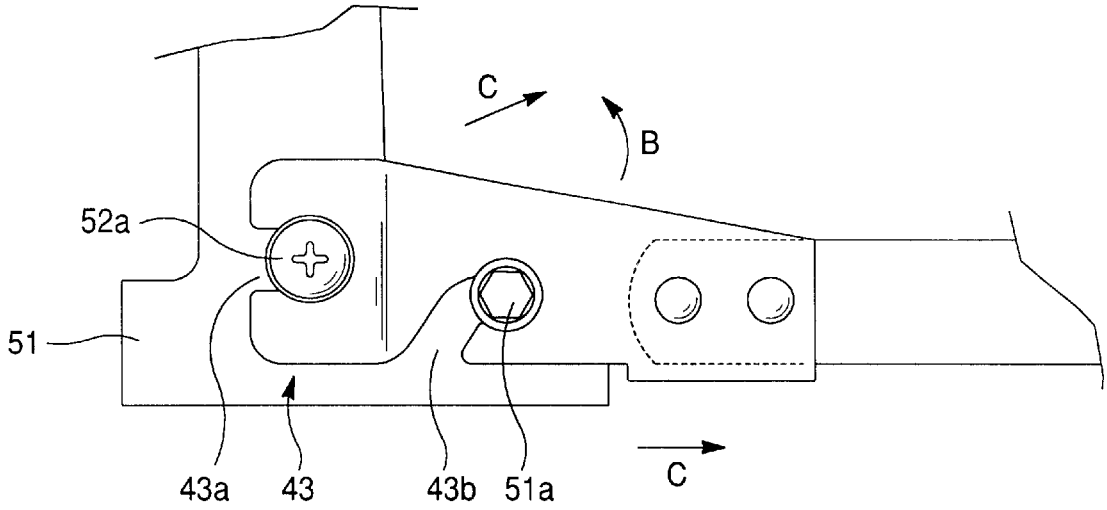
FIGS. 3*a* and 3*b* are partial side views of the structure of the connection portion of the elongated struts 42 connecting the foot-operated pedal to the upright posts 52.
Figure 3B:
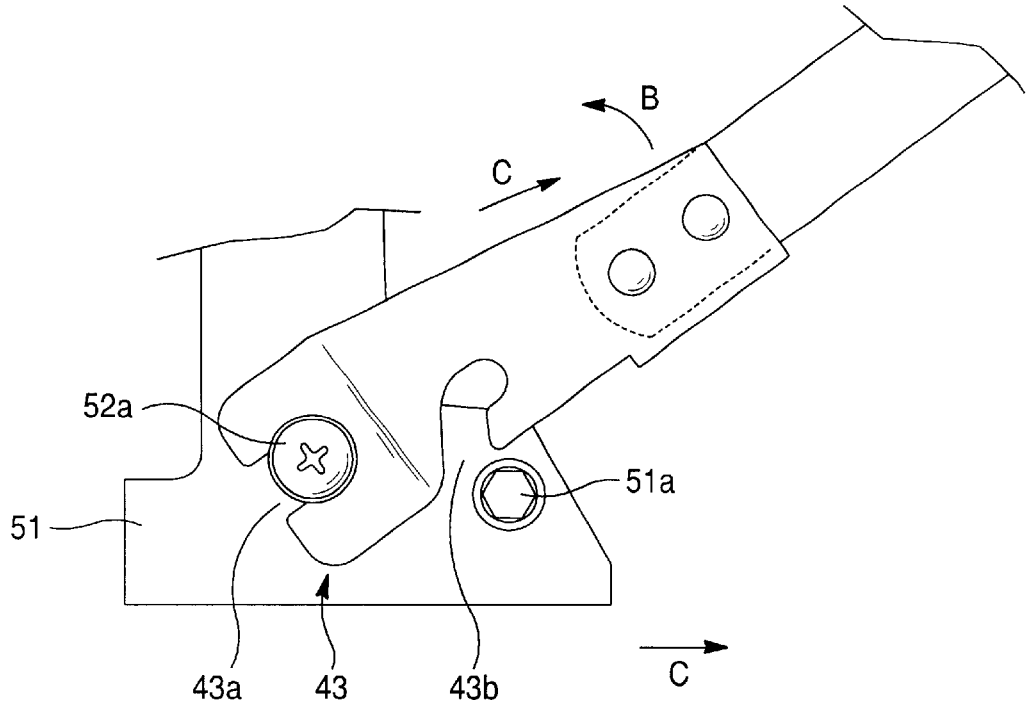

FIGS. 3*a* and 3*b* show the assembly process and structure of the connection portion of the elongated struts 42 connecting the foot-operated pedal to the upright posts 52. As described above, the L-shaped slots 43 enhance the connection and prevent unwanted separation of the struts 42 from the posts 52 during use.

After this disassembly step, the foot-operated pedal assembly is only connected to the instrument by the chain or linking member 62 of the drive assembly 60. The chain member 62 may be disconnected from the foot pedal 44 at connection point 44*a* or the chain member 62 may be disconnected from the drive sprocket 64 at connection point 64*a*, but in the normal operation the chain member 62 remains connected to the functional components.

Figure 4:
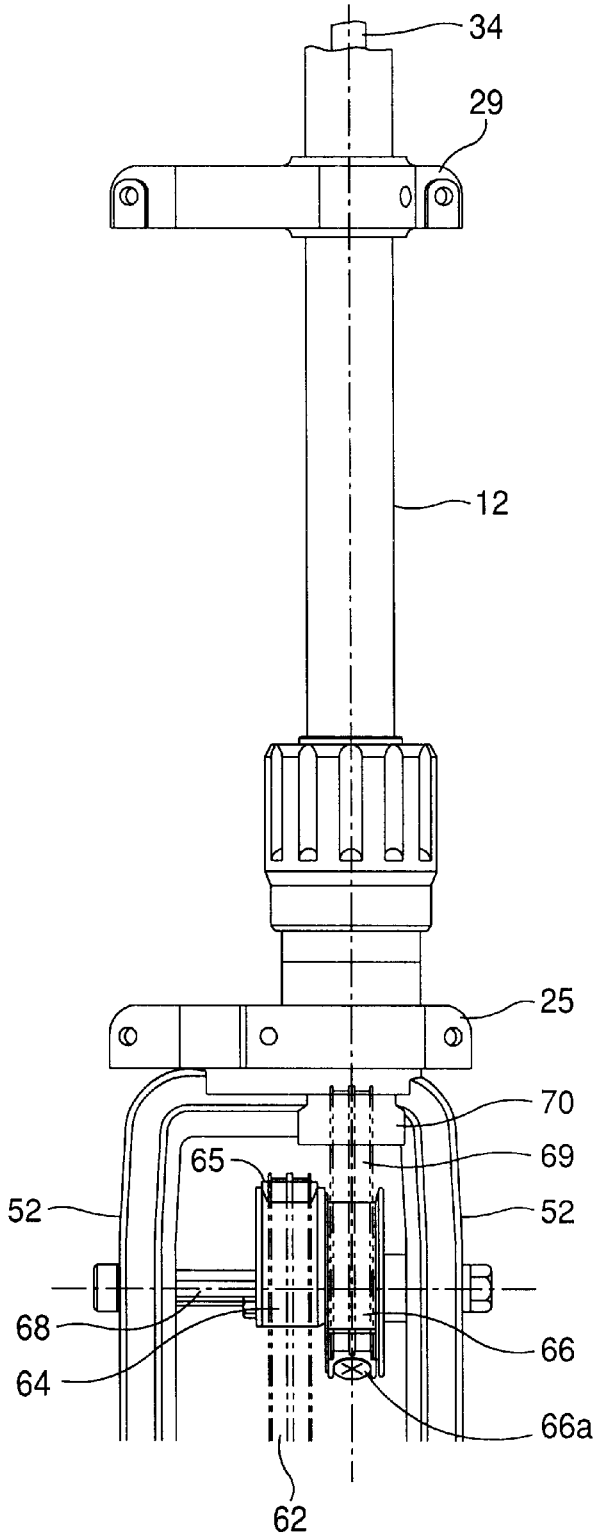
FIG. 4 is a partial cross sectional view of the drive mechanism of the invention of FIG. 3.
Figure 10:
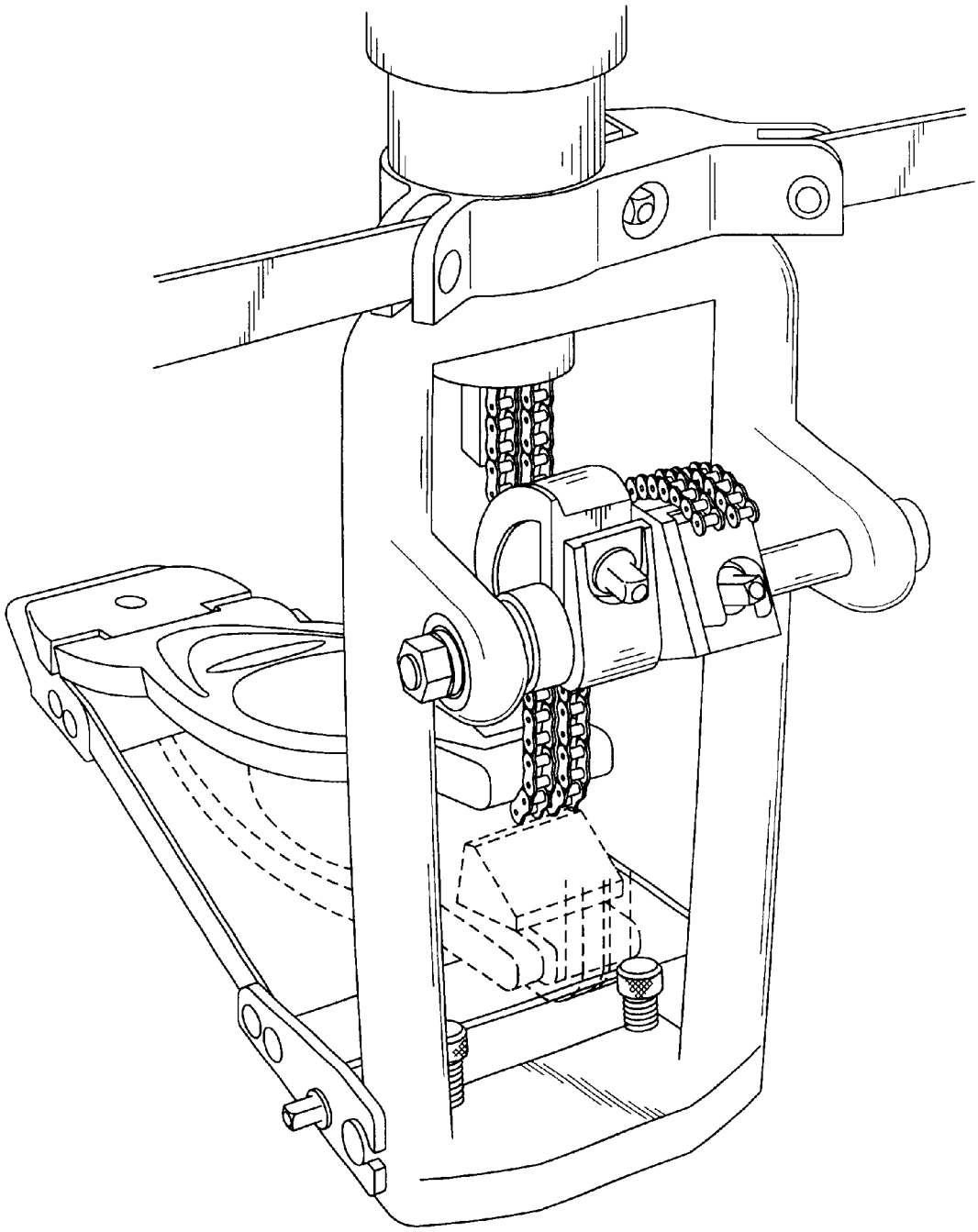
FIG. 10 is a perspective view of the dual-sprocket drive mechanism interconnecting the foot-operated pedal 44 with the movable rod 34.

With reference to FIG. 4, the drive assembly of this invention will now be described. The drive assembly 60 is mounted at an intermediate portion of the two upright laterally spaced posts 52 interconnected by the base portion 51. The posts and base portion are preferably metallic, and are typically made of zinc or steel. Central to the drive assembly is the horizontal shaft 68 rotatably mounted on an enlarged portion 53 (see FIGS. 2 and 10) of the two upright laterally spaced posts 52.

The drive assembly essentially consists of an input linking member 62 (e.g., chain 62) interconnecting the foot pedal 44 with a first input sprocket 64. The input sprocket 64 is drivingly mounted onto a horizontal shaft 68 along with a second output sprocket 66, which is likewise drivingly mounted onto the horizontal shaft 68. An output linking member (e.g., chain 69) interconnects the output sprocket 66 with the vertical movable rod 34.

The horizontal shaft 68 extends laterally between and is rotatably supported by the two upright posts 52; to this end, suitable shaft bearings may be located in the post's enlarged support portions 53. The shaft 68 may be polygonal to mount the sprockets 64, 66, and the sprockets 64, 66 may have a corresponding polygonal bore to closely fit the shaft. A set screw in sprockets 64, 66 engage the shaft 68 to position the sprockets 64, 66 on the shaft 68.

Flexible linking members, preferably chains, 62, 69 each have opposite end portions, one end portion of which is anchored to the sprockets 64*a*, 66*a*, respectively, and the other of which is anchored to the pedal 44 at portion 44*a* and the movable rod at portion 70, respectively. The forwardly elongated pedal 44 extends in inclined relation above the longitudinal struts 42, and the forward portion 44*a* of the pedal 44 is attached to the lower end of the chain 62 dependent below the forwardmost extent of the first input sprocket 64. The chain 62 is displaced downwardly as the pedal 44 is pressed downwardly, thereby rotating the input sprocket 64, the shaft 68, the output sprocket 66 and the movable rod 34, to thereby draw the movable upper cymbal 36 into engagement with the fixed lower cymbal 31.

Figure 5B:
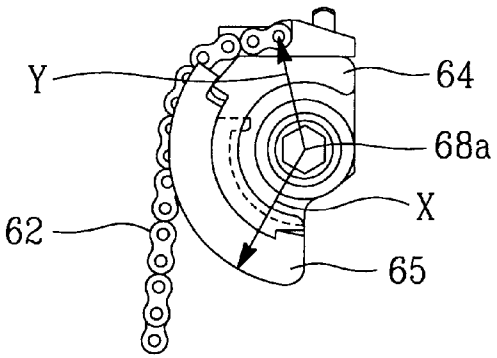
FIGS. 5*a* and 5*b* are exploded side views of the hub assembly as a first interchangeable cam member is being attached to the hub assembly via a tongue and groove type connection.
Figure 5A:
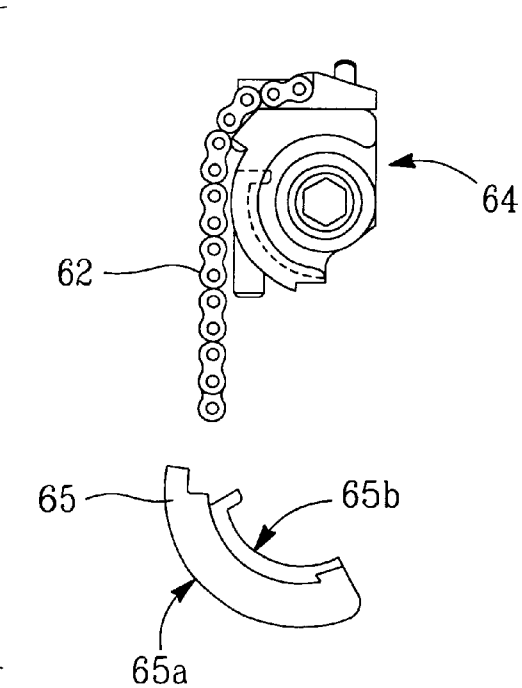

With reference to FIGS. 5A and 5B, it will be noted that the axis of rotation of the sprocket 64 and axle shaft 68 are eccentric relative to the outer cam member 65 mounted on the sprocket 64 engaged by the chain 62. In particular, the chain 62 has a mid-portion 62*b* engaging the outer cam surface of the selectively removable cam member 65, whereby the outer cam surface may provide a uniform distance (compare distance X with distance Y in FIG. 5B) from the axis of the shaft 68, or a progressively increasing distance (compare larger distance X with lesser distance Y, for example, in FIGS. 9D and 9E) from the axis of the shaft 68, along the chain length in a direction toward the forward portion 44*a* of the pedal 44. As a result, the pedal accelerates faster the travel of the axle 68 in the counterclockwise direction in FIG. 3, as during initial rotation of the sprocket 64 by the chain 63, due to the longer torque arms, of which distance X is representative, relative to the shorter torque arms (e.g., Y) which are in effect as the sprocket 64 completes its rotation. As a result, the output sprocket 66, chain 69 and movable rod 32 are driven at a variable rate depending on the torque arms defined by the eccentric cam member 65. This eccentric configuration enables more accurate timing of cymbal beating. Also, the cam effect serves to move forwardly the chain extent hanging below the sprocket as the sprocket 64 returns to the starting position, thereby bringing the pedal up faster than if the sprocket 64 rotated about its true center.

In the preferred embodiment, the drive assembly 60 consists of one eccentric interchange cam member 65 disposed on the sprocket 64, whereby the cam 65 is selected from a group of cams each designed with a specific cam profile. The eccentric cam member 65 engages the input-linking member 62 in the manner described above. In the embodiment shown in FIGS. 2–4, the second sprocket 66 does not include an interchangeable cam profile member. Each cam profile for the cam member 65 is chosen to provide a versatile and easily adaptable set of interchangeable cam combinations that enhance percussion performance.

While the preferred embodiment of this invention provide a single interchangeable cam assemblies, it will be understood by those of skill in the art that a pair of interchangeable cam assemblies may be suitably affixed to both sprockets 64, 66 for all percussion systems utilizing a foot-operated assembly without departing from the spirit and scope of the invention.

In addition, the present invention may include a single sprocket member having an interchangeable cam member wherein no second sprocket is provided. In this arrangement, the single sprocket member is connected both to the foot-operated pedal as well as the movable rod.

In the preferred embodiment of this invention, the heel plate 41 may be adjusted relative to the horizontal struts 42 to one of a plurality of positions. By shifting the heel plate 41 forward or back, the leverage and thus the feel of the pedal is altered from light, medium, and heavy to suit the player's personal playing style. The specific feature of the adjustable heel plate are set forth in U.S. Pat. No. 5,574,237 which is hereby incorporated by reference.

As opposed to prior art hi-hat percussion instruments, the drive mechanism of the present invention comprises a drive axle 68 upon which is mounted at least one sprocket member 64, 66 for actuating the cymbal members. With the overall system of this invention, the movement and precision of the vertically movable rod 34 is stabilized and enhanced when compared to the prior art because the movable rod is driven by the drive axle 68 and the sprocket members disposed between the foot-operated pedal and the movable rod 34. The prior art arrangement simply utilizes a hinged pedal hanging from a biased movable rod and connected therebetween by a flexible chain, and actuation of the cymbals with this conventional arrangement is less stable and less accurate. Accordingly, the present invention provides not only a more versatile actuation system, but also a sturdy, compact, reliable and more accurate pedal unit.

With reference to FIGS. 5A through 9, the interchangeable cam system of this invention will now be described with reference to the sprocket 64. Where two cam profiles are employed, it should be noted that the description and enhancements apply equally to the second output sprocket 66 and its associated cam profile member. As shown in FIGS. 5*a* and 5*b*, the sprocket 64 is formed as a two-piece member comprising a hub portion and a removable (interchangeable) cam portion 65. The cam portion 65 is formed with an outer cam surface 65*a* and an inner fastening section 65*b* that matingly engages the hub portion 64 through a tongue-and-groove snap-fit system.

The profile of the cam portion 65 is designed to provide predetermined performance characteristics and playing response for the percussion system. With this invention, the cam profile may be selectively changed by the user to suit the style and ability of the user. Depending on the cam profile affixed to the sprocket hub 64, the pedal accelerates or decelerates the travel of the movable cymbal 36 toward the stationary or fixed cymbal 31, as during initial rotation of the sprocket by the chain, due to the variable torque arms (see distance X) relative to the shorter torque arms (see distance Y) which are in effect as the sprocket completes its rotation and as the movable cymbal 36 closely approaches the lower fixed cymbal 31. This also enables more accurate timing of the percussion sound. Also, the cam effect serves to alter chain extent hanging below the sprocket, as the chain returns to the sprocket, thereby bringing the pedal up faster than if the sprocket rotated about its true center.

Figure 6B:
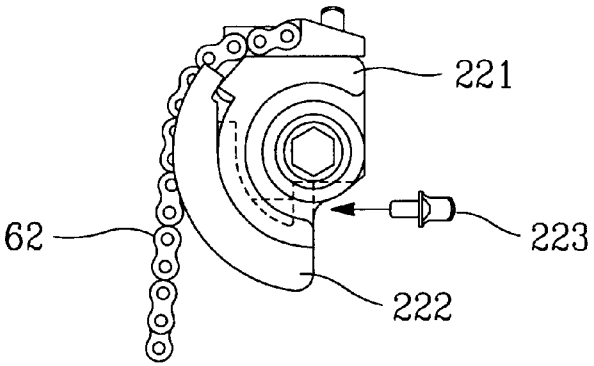
FIGS. 6*a* and 6*b* are exploded side views of the hub assembly as another interchangeable cam member is being attached to the hub assembly via a bolt type connection.
Figure 6A:
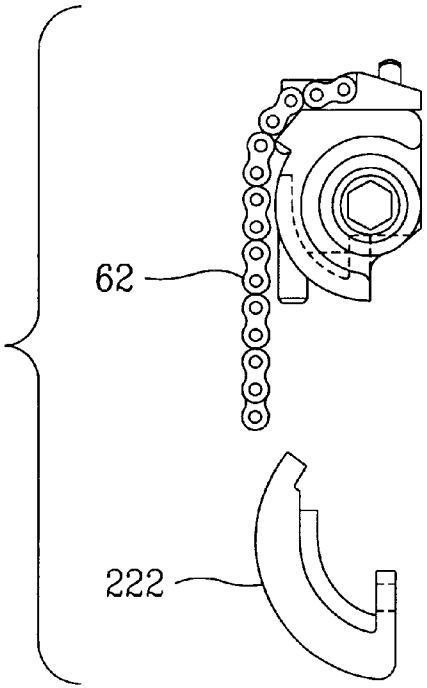
Figure 8:
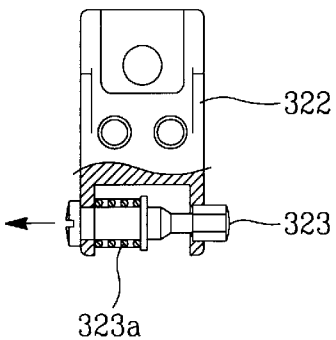
FIG. 8 is a partial cross sectional view of the push-to-release type cam fastener shown in FIGS. 7*a* and 7*b;*
Figure 7B:
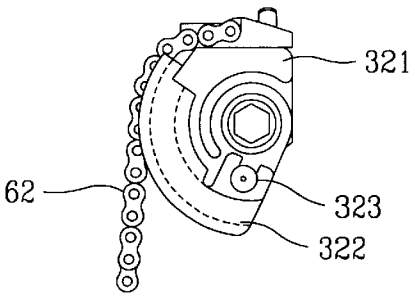
FIGS. 7*a* and 7*b* are exploded side views of the hub assembly as another interchangeable cam member is being attached to the hub assembly via a push-to-release type connection.
Figure 7A:
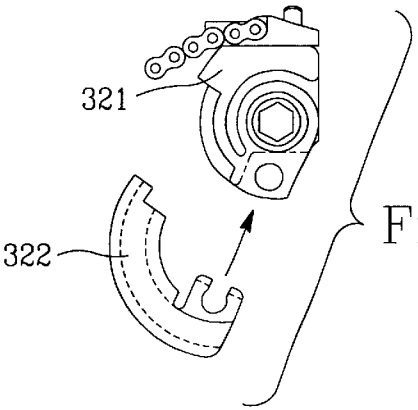

Although the cam and sprocket assembly of FIG. 7 shows a particular fastening system, this invention should not be limited to any particular fastening system. FIGS. 6*a* and 6*b* show an alternative arrangement wherein a bolt 223 secures the cam portion 222 to the hub portion 221. Likewise, FIGS. 7*a* and 7*b* show a push-release fastening arrangement for the interchangeable cam system of this invention. In FIGS. 7*a* and 7*b*, a spring-loaded pin-type fastener 323 secures the cam portion 322 to the hub portion 321, and a spring 323*a* biases the fastener 323 into the locking position. FIG. 8 is a partial cross sectional view of the push-release type cam fastener shown in FIGS. 7*a* and 7*b*.

Figure 9A:
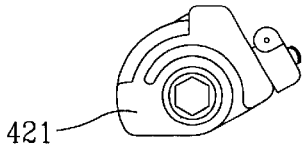
FIGS. 9*a*–9*e* shown the hub assembly of this invention with no cam member disposed thereon, as well as four different side views showing four different cam profiles selectively attached to the same hub assembly as envisioned by this invention.
Figure 9B:
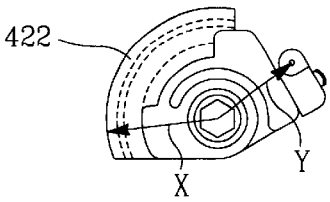
Figure 9C:
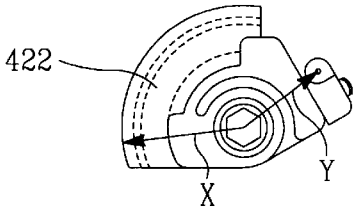
Figure 9D:
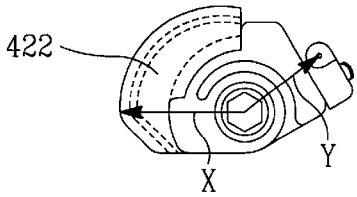
Figure 9E:
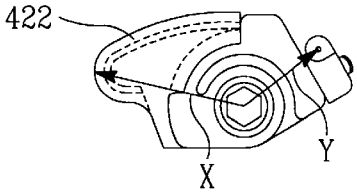

As shown in FIGS. 9*b* through 9*e*, the present invention encompasses a wide variety of interchangeable cam profiles having different performance characteristics for the beater system. FIG. 9*a* shows the hub portion 421 absent any cam portion. FIGS. 9*b*–9*e* show four different cam portions 422 exemplifying the modular and interchangeable nature of the cam system of this invention. Depending on the particular cam profile employed by the user, the effective length of the torque arm changes at different rates to provide different performance characteristics.

While the foregoing invention has been shown and described with reference to a number of preferred embodiments, it will be understood by those having skill in the art that various changes in form and detail may be made therein without departing from the spirit and scope of this invention. Most notably, the specific structural layout for the hi-hat actuation system should not be limited to the configuration shown in the appended drawings because this invention may be practiced with a single interchangeable cam system or two interchangeable cam systems. In addition, the attachment system for the cam profile members may be varied in an infinite number of ways without departing from the spirit of the present invention.

What is claimed is:

1. A percussion pedal system for actuating a percussion instrument with a foot-actuated pedal mechanism, said system comprising:

a pedal member designed to be actuated by a foot of a user;

at least one sprocket member mounted to pivot about an axis of rotation, said sprocket member comprising a sprocket hub mounted on an axle and a first cam profile member detachably connected to said sprocket hub;

a flexible drive linking member drivingly connecting said pedal member with said sprocket member;

sound generating means for generating a percussion sound, said sound generation means driven by said pedal member through said flexible drive linking member;

at least one additional cam profile member that is interchangeable with said first cam profile member to thereby provide a plurality of cam profiles designed to interchangeably fit onto said sprocket hub;

wherein said first cam profile member is removable from said sprocket hub while said sprocket hub remains affixed to said axle to thereby provide an interchangeable cam profile arrangement.

2. The drum pedal system of claim 1, wherein said system comprises first and second sprocket hubs mounted on said axle and first and second cam profile member respectively mounted on said sprocket hubs.

3. The drum pedal system of claim 2, wherein said flexible drive linking member drivingly connects said pedal member with said first sprocket member and a second flexible linking member drivingly connects said second sprocket hub and said second cam profile member to said sound generating means.

4. The drum pedal system of claim 1, wherein said cam profile member is connected to said sprocket hub via a snap-fit connection.

5. The drum pedal system of claim 1, further comprising a threaded fastener connecting said cam profile member to said sprocket hub.

6. The drum pedal system of claim 1, further comprising a press-to-release pin member connecting said cam profile member to said sprocket hub.

7. The drum pedal system of claim 1, wherein, as the pedal member moves down causing a vertically movable actuation rod to draw two cymbals together, an effective length of a torque arm exerted on the at least one sprocket member by the drive linkage decreases.

8. The drum pedal system of claim 7, wherein said effective length gradually decreases as the pedal member moves down.

9. The drum pedal system of claim 7, wherein said effect length initially increases then rapid decreases as the pedal member moves down.

10. The drum pedal system of claim 1, wherein said sound generating means comprises a vertically movable actuation rod and at least one cymbal connected to said actuation rod.

11. The drum pedal system of claim 1, wherein said drive linkage overlies a portion of said cam profile member to define a torque arm exerted on said sprocket member when said pedal member is moved down to thereby cause said sound generating means to generate a percussion sound.

12. A sprocket member assembly for a foot actuated pedal system for a hi-hat percussion instrument, said sprocket member comprising:

a sprocket hub comprising an aperture sized to receive a pivot axle passing therethrough, said sprocket hub pivoting about an axis of rotation defined by said pivot axle during operation;

a cam profile member detachably connected to said sprocket hub, said cam profile member having an outer cam surface at least partially circumscribing said axis of rotation, wherein said cam profile member is connected to said sprocket hub via at least one of a snap-fit connection, a threaded fastener, and a press-to-release pin member.

13. The sprocket member assembly of claim 12, wherein said outer cam surface defines a torque arm exerted on said sprocket member when a drive force is applied to said sprocket member to move a vertically movable actuator rod connected to a cymbal.

14. The sprocket member assembly of claim 13, further comprising a drive linkage connected to said sprocket hub and overlying said outer cam surface to thereby define said torque arm when a tension is applied to said drive linkage.

15. The sprocket member assembly of claim 12, further comprising a predetermined disconnection interface between said sprocket hub and said cam profile member, said disconnection interface providing a selective disconnection mechanism to permit removal of said cam profile member from said sprocket hub.

16. A drum pedal kit for providing a versatile foot-actuated percussion instrument, said kit comprising:

a pedal member designed to be actuated by a foot of a user;

a sprocket member mounted to pivot about an axis of rotation, said sprocket member Comprising a sprocket hub mounted on an axle and a plurality of cam profile members interchangeably connected to said sprocket hub, each cam profile member comprising an outer cam surface that defines a varying torque arm exerted on said sprocket member when a drive force is applied to said sprocket member;

a drive linkage drivingly connecting said pedal member to said sprocket member to thereby provide said drive force to said sprocket member;

a sound generating means for generating a percussion sound upon actuation of said pedal member;

wherein a user may selectively connect one of said plurality of cam profile members to said sprocket hub to thereby provide a different performance characteristic for said foot-actuated percussion instrument.

17. A percussion pedal system for actuating a percussion instrument with a foot-actuated pedal mechanism, said system comprising:

a pedal member designed to be actuated by a foot of a user;

first and second sprocket members mounted to pivot about an axis of rotation, said sprocket members comprising a sprocket hub mounted on an axle;

a first flexible drive linking member drivingly connecting said pedal member to said first sprocket member;

a vertically movable actuation rod mounting at least one cymbal connected to said actuation rod;

a second flexible drive linking member drivingly connecting said vertically movable actuation rod to said second sprocket member; and a first cam profile member removably disposed on said first sprocket member, and at least one additional cam profile member that is interchangeable with said first cam profile member to thereby provide a plurality of cam profiles designed to interchangeably fit onto said sprocket hub;

wherein said first cam profile member is removable from said sprocket hub while said sprocket hub remains affixed to said axle to thereby provide an interchangeable cam profile arrangement.

* * * * *